US006732714B2

(12) United States Patent
Frenz et al.

(10) Patent No.: US 6,732,714 B2
(45) Date of Patent: May 11, 2004

(54) METHOD, COMPUTER PROGRAM, AND CONTROL AND/OR REGULATING DEVICE FOR OPERATING AN INTERNAL COMBUSTION ENGINE

(75) Inventors: Thomas Frenz, Noerdlingen (DE); Winfried Langer, Illingen (DE); Stefan Keller, Eberdingen (DE); Marco Zucchini, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 81 days.

(21) Appl. No.: 10/224,216

(22) Filed: Aug. 20, 2002

(65) Prior Publication Data

US 2003/0037769 A1 Feb. 27, 2003

(30) Foreign Application Priority Data

Aug. 27, 2001 (DE) ..... 101 41 821

(51) Int. Cl.[7] ..... F02M 51/00
(52) U.S. Cl. ..... 123/479; 73/119 A
(58) Field of Search ..... 123/446, 479, 123/357; 73/119 A

(56) References Cited

U.S. PATENT DOCUMENTS 5,293,853 A * 3/1994 Berger et al. ..... 123/357
6,119,656 A * 9/2000 Schmidt ..... 123/456

* cited by examiner

*Primary Examiner*—Thomas N. Moulis
(74) *Attorney, Agent, or Firm*—Michael J. Striker

(57) ABSTRACT

In an internal combustion engine, a real fuel quantity (rk_w), supplied from a high-pressure region of a fuel system into a combustion chamber of the engine, depends on a real rotational moment. In addition, the control duration (dwmsvo) of a volume control valve, with which the fuel supplied from a fuel pump into the high-pressure region can be affected, depends on the difference between a real pressure and a determined pressure (prist) in the high-pressure region. The supply output of the fuel pump, which supplies into the high-pressure region, depends in turn on the rotational speed (nmot) of a crankshaft of the engine. In order to avoid problems relating to too much or too little fuel being injected into the combustion chamber of the engine, it is proposed that a real control duration (dwmsvo) of the volume control valve, the determined rotational speed (nmot) of the crankshaft of the engine, and the determined pressure (prist) in the high-pressure region determine a test fuel quantity (rk_um) and that this test fuel quantity is compared with a real fuel quantity (rk_w_determined from the real rotational moment.

13 Claims, 4 Drawing Sheets

METHOD, COMPUTER PROGRAM, AND CONTROL AND/OR REGULATING DEVICE FOR OPERATING AN INTERNAL COMBUSTION ENGINE

BACKGROUND OF THE INVENTION

The present invention relates to first a method for operating an internal combustion engine, in which a real quantity of fuel, which is lead from a high-pressure region of a fuel system into a combustion chamber of the internal combustion engine, is dependent on a rated rotational moment. The control duration of a volume control valve, with which the volume of fuel that is supplied into the high-pressure region from a fuel pump can be affected, depends on the difference between a desired pressure and an intermediate pressure in the high-pressure region, and in which the supply output of the fuel pump, which is supplied into the high-pressure region, depend on the rotational speed of a drive shaft of the fuel pump.

This type of method is known from the market. A combustion engine with a fuel system is known, which includes an electric fuel pump that supplies the fuel from a fuel container to a high-pressure fuel pump. From this, the fuel is lead into a fuel collection line ("rail"), in which the fuel is stored under high pressure. Injectors are connected to the fuel collection line, which inject the fuel directly into the combustion chamber of the engine. Through the volume control valve, the pressure side of the high-pressure fuel pump can be short circuited during a supply stroke with the suction side. This enables the introduction of the fuel quantity supplied to the fuel controlling line.

The amount of the fuel fed into the combustion chamber results from the injection duration of the injectors. This depends on one hand on the real rotational moment of the internal combustion engine and on the other hand, on the pressure which exists in the high-pressure region to which the injectors are connected. For a determined real rotational moment, the injectors are open longer with a lower pressure in the high-pressure region than with a higher pressure. The pressure in the high-pressure region is detected by a pressure sensor. The injection time of the injectors is increased with a fuel pressure that is determined to be too small due to an error in the sensor, which can lead to an undesired acceleration of the vehicle. On this basis, the function of the pressure sensor is monitored.

However, it is not completely out of the question that in determined situations that an unwanted acceleration of the vehicle can occur, in which such an internal combustion engine is included. It is therefore one object of the present invention to provide an improved method of the above-described type so that the internal combustion engine always works controllably.

This problem is resolved with a method, which from a desired control duration of the volume control valve, the determined rotational speed of the drive shaft of the fuel pump or the determined rotational speed of a crank shaft of the combustion engine driven by the fuel pump and the determined pressure in the high-pressure region, a test-fuel quantity is determined and is compared with the real fuel quantity determined from the real rotational moment.

SUMMARY OF THE INVENTION

With the method of the present invention, it is possible to not only monitor the functioning of the pressure sensor, rather to monitor entirely the determination of the fuel quantity to be injected. In this manner, such situations can be identified in which the pressure sensor works error-free, however, other values are incorrect, from which the fuel quantity actually to be injected from the injectors depends. This can be the situation, for example, when the real fuel quantity from the real rotational moment is accepted in error. An incorrect acceptance of the control duration of the volume control valve is also possible, however.

With the method of the present invention, also such errors can be known doubtfree. This occurs thereby that the fuel quantity, which should be injected into the combustion chamber of the engine, is recalculated over the real control duration of the volume control valve, over, for example, the rotational speed of the crank shaft of the internal combustion engine determined from a sensor, and over the pressure in the high-pressure region determined by a sensor.

Underlying this concept is that each fuel volume that is called from the injectors from the fuel controlling line must be again subsequently supplied from the second fuel pump in order to correctly maintain a determined pressure in the fuel controlling line. The supply volume of the second fuel pump depends in turn on the control time, or the closing duration, of the volume control valve and the rotational speed of the drive shaft of the second fuel pump. Since this is usually driven by the camshaft of the internal combustion engine, here the rotational speed of the engine, which typically is determined from on its crankshaft, can be used.

The inventive method, therefore, can be performed without requiring additional components. In the most cost-efficient manner, the operation of the internal combustion engine can be made more reliably and dependably.

In a first further development, it is proposed that the difference from the test fuel quantity and the real fuel quantity is created and the total difference is compared with a threshold value. Thereby, in a simple manner, a tolerance graph is produced, through which a dependable branching-off between the test fuel quantity and the real fuel quantity is defined. Through such a tolerance graph, for example, a dynamic effects, additional measurement accuracy, and so forth can be considered.

Therefore, it is possible that the test fuel quantity is determined by means of two characteristic curves. These characteristic curves are only dependent on the rotational speed of the fuel pump, or the internal combustion engine, and the fuel pressure in the high-pressure region. This is very simple to realize.

Alternatively, it is also possible that the test fuel quantity is determined by means of a multi-dimensional performance graph. The expense here is indeed larger, however, the accuracy and speed of calculation are better.

Particularly preferable is each further development of the inventive method, in which the performance of the comparison between the test fuel quantity and the real fuel quantity depends on the rotational speed of the crankshaft of the internal combustion engine. In this manner, the actual calculation shows that the test fuel quantity depending on the rotational speed quite differently affects normal and system-related tolerances of individual components.

It is especially preferable that with low rotational speeds of the internal combustion engine, in particular, below approximately 122 rpm, no comparison between test fuel quantity and real fuel quantity takes place. In particular, with such low rotational speeds, a comparison between test fuel quantity and real fuel quantity makes little sense, since the normal tolerances of the individual components of the engine in this rotational speed region already can lead to marked departures of the test fuel quantity from the real fuel quantity.

It is also advantageous in each embodiment of the method of the present invention that an error message or signal occurs and/or an alarm is released when the test fuel quantity and the real fuel quantity diverge more than is permitted from one another. The error message, for example, can be read out upon maintenance, so that the maintenance provider receives direction information and the necessary repairs can be made. In this manner, the maintenance of the engine is made easier. An alarm signals to the user of the engine directly that the engine is no longer functioning error-free. In the case of the use of the engine in a motor vehicle, the alarm signal can be included as a warning light on the dashboard, for example.

In a further embodiment, it is proposed that, based on an error message, a safety step is performed. When the comparison of the test fuel quantity with the real fuel quantity provides that the danger exists that the fuel quantity is or would be determined in error, and therewith the actual, produced rotational moment does not correspond to the desired rotational moment of the user of the engine, through the introduction of such a safety step, the operation of the engine that can pose a danger for the components of the engine and the life of the user can be prevented.

In order to prevent that such a safety measure is produced unnecessarily, it is proposed that the safety measure is only performed when the error message is produced over a determined amount of time. With this embodiment of the inventive method, short and one-time measurement error and/or calculator errors do not lead to an initiation of a safety step. This is limited to each case in which a continual, serious error is determined based on the comparison between the testing fuel quantity and the real fuel quantity.

Further, it is proposed that the safety mechanism includes an actuator of the fuel supply. This means only that the internal combustion engine is switched off. Through this radical safety step, further incorrect operation of the internal combustion engine leading to further damage is prevented. Also, a risk for the user of such an incorrectly operating engine is thereby reduced.

The invention relates also to a computer program, which is suited for performing the above-described method, when it is performed on a computer. Thereby, it is especially preferable when the computer program is stored on a storage, in particular, on a flash memory.

Further, the invention relates to a control and/or regulating apparatus for operating an internal combustion engine. In order to improve the safety upon operation of such an engine, it is proposed that the control and/or regulating apparatus includes a storage, on which a computer program of the above-describe type if stored.

DETAILED DESCRIPTION OF THE PREFERRED EMBODIMENTS

Figure 1:
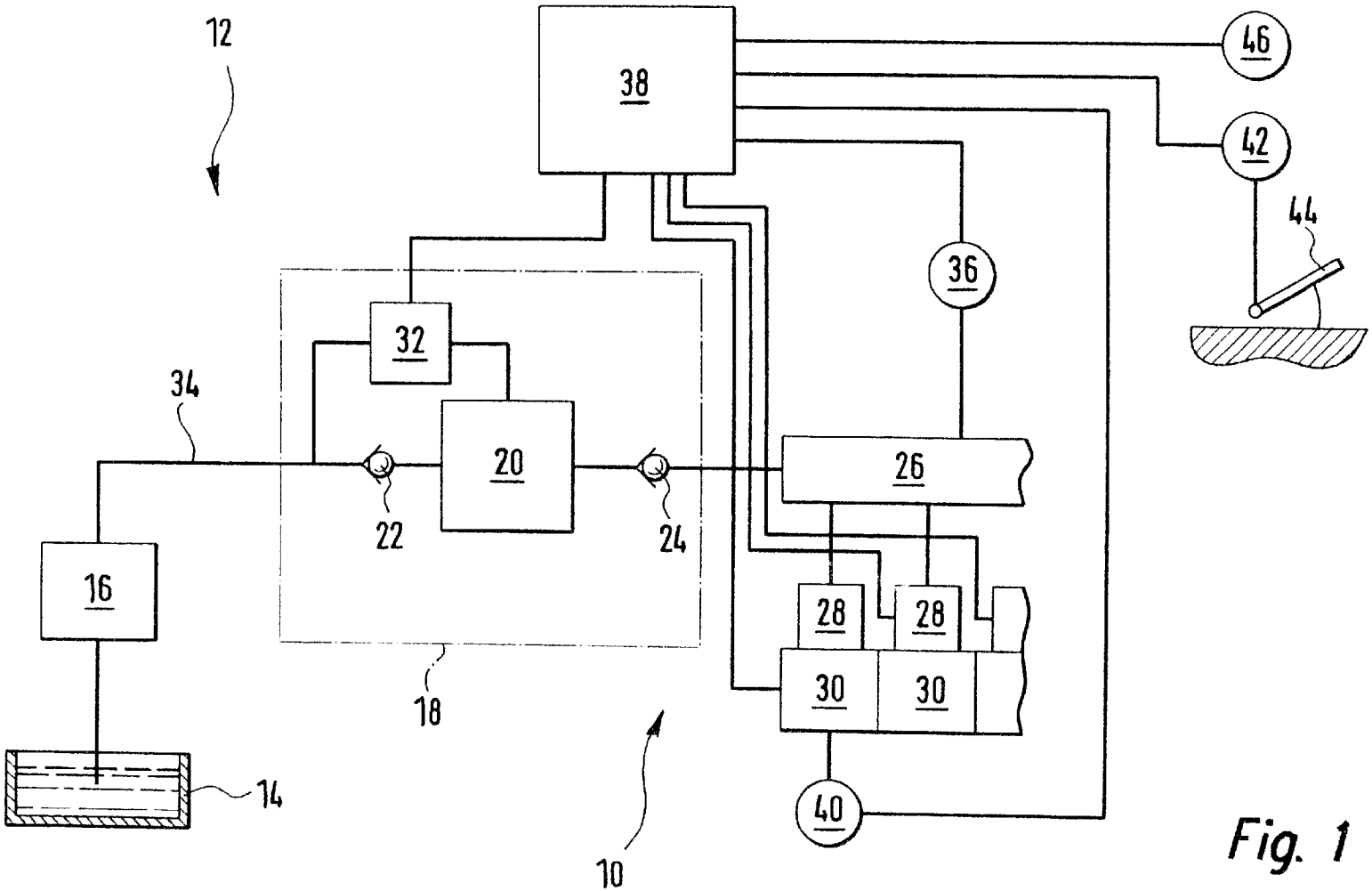
FIG. 1 is a schematic representation of an internal combustion engine.

In FIG. 1, an internal combustion engine in its entirety is designated with reference numeral 10. The engine 10 is supplied with fuel by a fuel system 12, which includes a fuel container 14, from which an electric fuel pump 16 supplies the fuel to a high-pressure fuel pump 18.

The fuel pump 18, in turn, includes a working chamber 20, whose size depends on the position of a piston (not shown). The piston is directly driven by a camshaft (not shown) of the internal combustion engine 10. Upstream from the working chamber 20 a first check or relief valve 22 is provided, and downstream from the working chamber 20, a second check valve 24 is provided.

The high-pressure fuel pump 18 supplies into a fuel controlling line 26 ("rail"), to which multiple injectors 28 are connected, which injected the fuel into the combustion chamber 30.

The fuel quantity from the high-pressure fuel pump 18 supplied in the fuel controlling line 26 is affected by a volume control valve 32. This can connect the high-pressure fuel pump 18 of the working chamber 20 at least part of the time with a fuel line 32 upstream from the check valve 22 during a supply phase of the piston. IN this case, the fuel is not pressed in the fuel controlling line 26, rather supplied back in the fuel line 34. Depending on the opening duration of the volume control valve 32, then, more or less fuel is supplied into the fuel controlling line 26.

The pressure in the fuel controlling line is detected by a pressure sensor 36, which gives out a corresponding signal to a control or regulating apparatus 38. This is also connected on the inlet side with a rotational speed sensor 40, which picks up the rotational speed of a crankshaft (not shown) of the internal combustion engine. A remote-position indicator 42 engages picks up the position of a gas pedal 44 and produces a corresponding signal to the control and regulating apparatus 38. Further, by way of example, another sensor 46 is shown, which makes available a relevant size of the control and regulating apparatus 38 for the operating condition of the internal combustion engine 10. In this manner, it can sense, for example, the temperature of the suction air. However, it is also possible that it detects with the sensor 46 a heat film or HFM sensor, which detects the air quantity in the combustion chamber 30 of the internal combustion chamber 10.

The internal combustion engine 10 is operated in the following steps (FIGS. 2 through 7):

The real rotational moment essentially is determined by the position of the gas pedal, which is determined by a remote-position indicator 42. A signal wped corresponding to the position of the gas pedal 44 leads to a performance graph 48 (such as FIG. 2). In this, also the signal from the sensor 46 is applied. In the performance graph 48, a real fuel quantity rk_w is determined as the output quantity.

This real fuel quantity rk_w should be injected from the injectors 28 into the corresponding combustion chamber 30. The amount of the actual fuel injected into the combustion chamber 30 from the injectors 28 is determined by the injection duration ti_w. An ideal value ti_w for the injection duration is determined in a performance graph 50 (such a FIG. 3). In this, on the one hand, the real fuel quantity rk_w is applied, and on the other hand, the pressure prist detected by the pressure sensor 36 in the fuel controlling line 26 is applied. The consideration of the existing pressure in the fuel controlling line 26 is based on the factor that with a determined injection duration and a relatively low pressure in the fuel controlling line 26, less fuel is supplied into the combustion chamber 30 as with the same injection time ti_w but with a higher pressure in the fuel controlling line 26. By the performance graph 50, pressure differences of this type in the fuel controlling line can be compensated.

Figure 4:
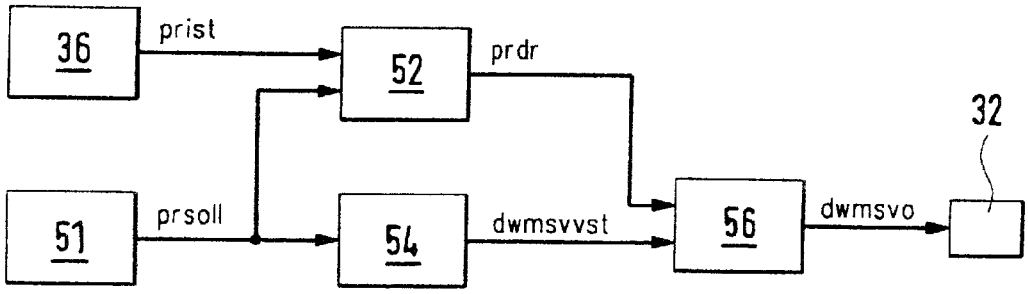
FIG. 4 is a flow diagram, in which the determination of an opening angle of a volume control valve of the internal combustion engine of FIG. 1 is represented.

The pressure in the fuel controlling line 26, in turn, is maintained by means of a closed regulating circuit, shown in FIG. 4, at a desired level prsoll. The rated pressure prsoll is determined in Block 52 dependent on various parameters. From the difference between the ideal value prsoll and the pressure prist in the fuel controlling line 26 detected by the pressure sensor 26, a controlling part prdr is determined in Block 52. The ideal value prsoll for the pressure in the fuel controlling line 26 also leads to a characteristic curve 54, which determines an anticipatory control value dsmsvvst for the opening angle of the volume control valve 32. This, in turn, is applied together with the controlling part prdr for the fuel pressure in the performance graph 56, in which the ideal value dwmsvo for the opening angle of the volume control valve 32 is determined.

This opening angle corresponds to each angle of the crankshaft of the internal combustion engine 20, with which the volume control valve 32 is opened and the pressure side of the high-pressure fuel pump 20 is short-circuited with the suction side. The larger the opening angle, the longer the volume control valve 32 is closed and the more fuel is supplied with a stroke from the high pressure fuel pump 20 into the fuel controlling line 26. In this manner, the pressure in the fuel controlling line 26 is affected.

With the calculation of the injection duration ti_w, errors can occur on various grounds in specific cases:

Therefore, for example, based on an error of the pressure sensor 36, the fuel pressure prist can be determined incorrectly. It is also possible, however, that in Block 50 (FIG. 3), the ideal value rk_w for the fuel quantity is adopted incorrectly. Both would lead to a real injection time ti_w of the injectors 28, which is not desired by the user of the engine 10 and through a corresponding position of the gas pedal 44 corresponds to the expression of the real rotational moment. The case of a fuel pressure prist determined incorrectly from the pressure sensor 26 is shown by way of example in FIGS. 5 and 6.

Figure 5:
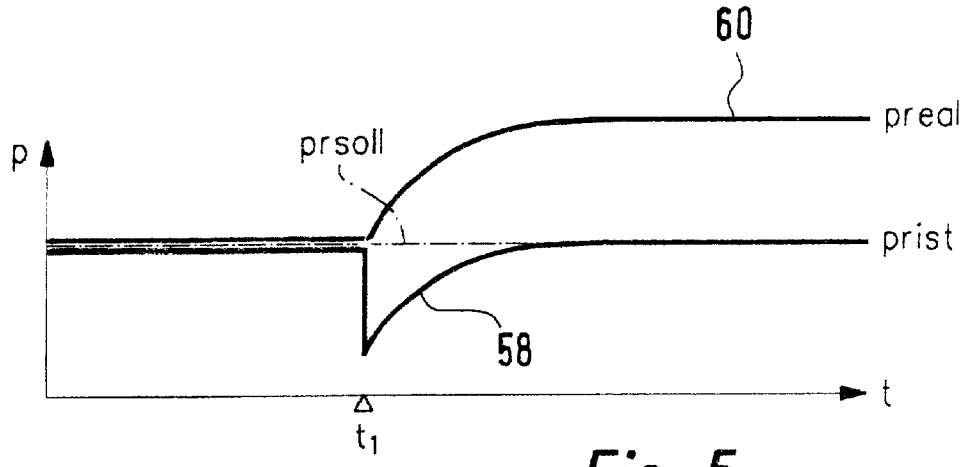
FIG. 5 is a diagram, in which the measured and the actual pressure in a high-pressure region of the internal combustion engine of FIG. 1 over the time are illustrated graphically.

As FIG. 5 shows, at the time point t1, the signal corresponding to the measured pressure prist suddenly falls (dashed line with reference numeral 58 in FIG. 5). This drop of the signal corresponds to an incorrect constant offset. The drop of the signal, as shown in the flow diagram of FIG. 4, has the result that a sharp divergence of the ideal value prsoll shown in FIG. 5 from a measured value occurs. This leads to the case that with the method shown in FIG. 4, the ideal value dwmsvo for the opening angle of the volume control valve 32 is lifted and, in this manner, the fuel quantity supplied into the fuel controlling line 26 is increased.

Thus, the actual pressure preal in the fuel controlling line 26 (reference numeral 60 in FIG. 5) increases. Since it is related to a constant offset upon the error in the pressure sensor 36, the actual pressure preal increases so long until the (incorrect) signal prist from the pressure sensor 26 to the control and regulating apparatus 38 again corresponds to the ideal value prsoll. The measuring error of the pressure sensor 36 leads, therefore, to an actual increased pressure preal in the fuel controlling line 26 as is detected from the pressure sensor 36.

Figure 3:
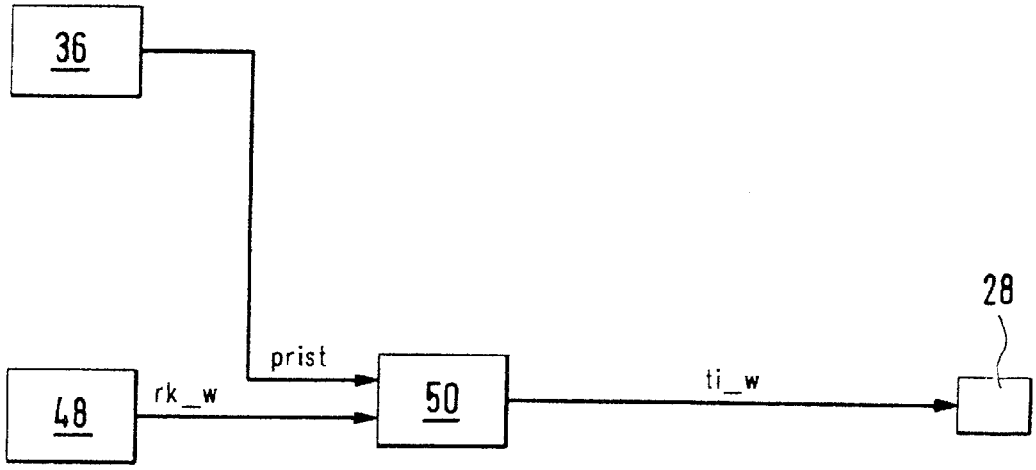
FIG. 3 is a flow diagram, in which the determination of a real fuel quantity for the internal combustion engine of FIG. 1 is represented.
Figure 6:
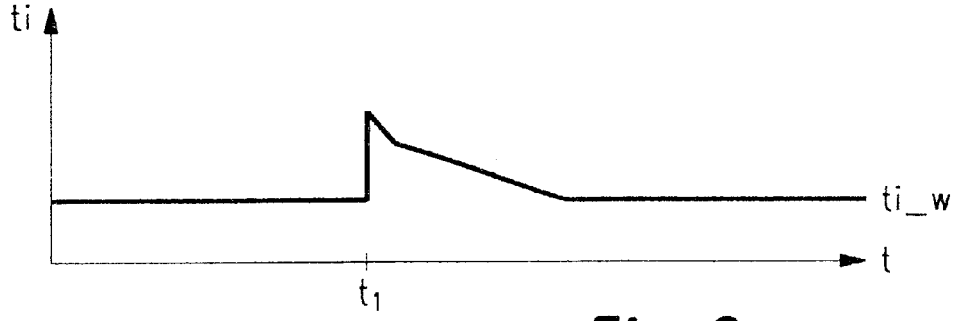
FIG. 6 is a diagram, in which the opening duration of an injector of the internal combustion engine of FIG. 1 over the time is represented.

Based on the time point t2 of the suddenly occurring drop of the signal prist, the injection duration ti_w is increased to compensation corresponding to the flow diagram of FIG. 3. This is represented in FIG. 6. Such an increase in the injection duration ti_w with real, normal pressure preal leads, however, to a sudden increase of the rotational moment. First, when the signal prist of the pressure sensor 36 again corresponds to the ideal pressure prsoll, the injection duration ti_w also again lies on the level of the normal value.

Since, however, as described above, the actual pressure preal in the pressure controlling line 26 is now higher than is detected from the pressure sensor 36, more fuel is injected during an injection duration ti_w than in the desired rotational moment and the fuel quantity rk_w determined here from corresponds. A vehicle, in which the engine is a component, would experience an unwanted acceleration and subsequently, would operate constantly with a higher rotational moment, without this being noticed by the user.

Figure 2:
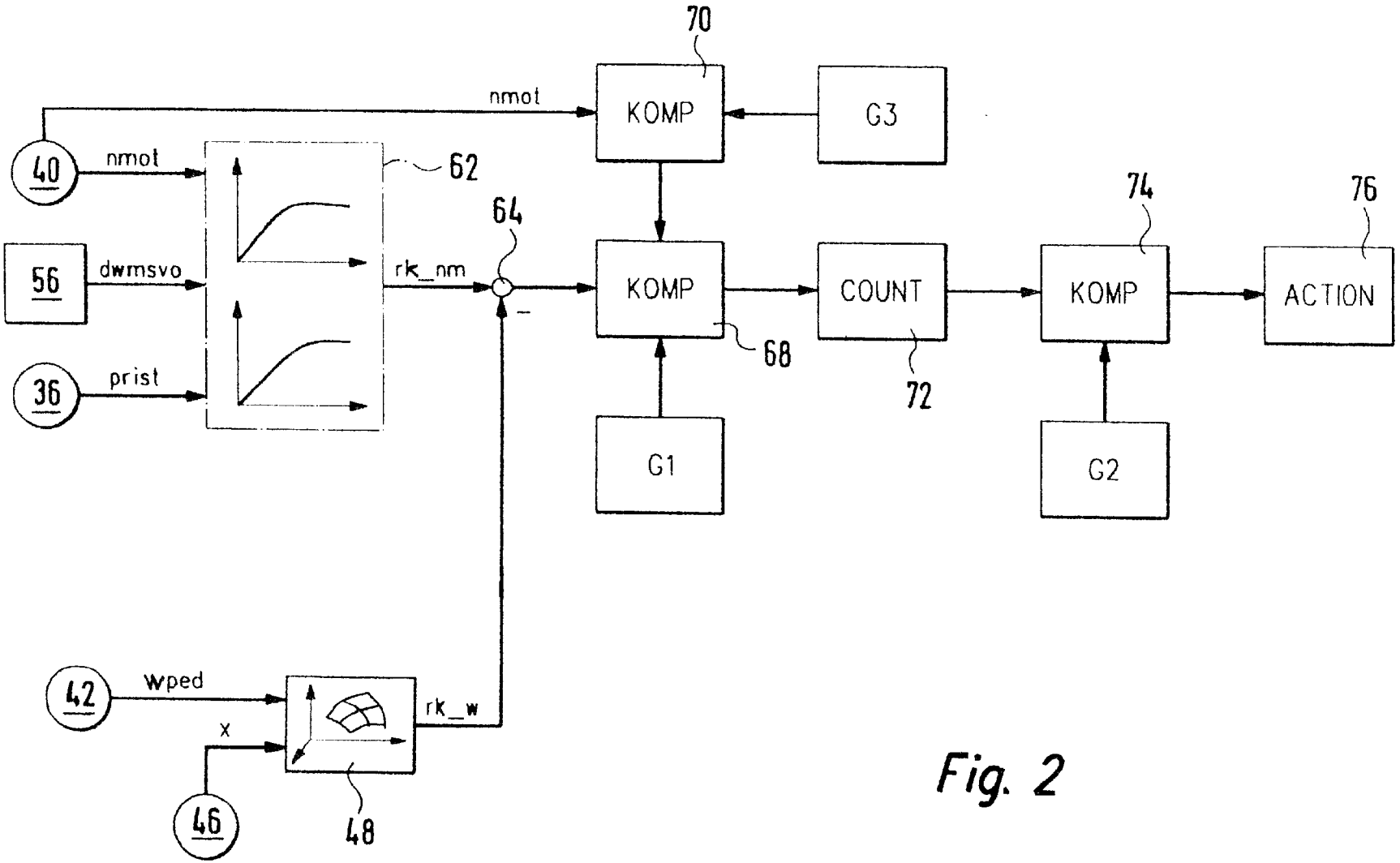
FIG. 2 is a flow diagram, which shows a method for comparing a real fuel quantity with a test fuel quantity of the internal combustion engine of FIG. 1.

In order to prevent all of this, the engine 10 of FIG. 1 is operated according to the method represented in FIG. 2:

First, the rotational speed nmot of the crankshaft of the engine 10 detected by the rotational speed sensor 40, the desired opening angle dwmsvo of the volume control valve 32, and the incorrectly detected pressure prist detected by the pressure sensor 36 is applied in a block 62 in two characteristic curves. In block 62, a test fuel quantity rk_um is determined. With the test fuel quantity rk_um, a recalculated fuel quantity is calculated, which corresponds to each fuel quantity that is supplied from the high-pressure fuel pump 18, under adoption of the initial values nmot, dwmsvo and prist, into the fuel controlling line 26. In 64, a difference is formed from this test fuel quantity rk_um and the determined real fuel quantity rk_w determined in the performance graph 48.

Figure 7:
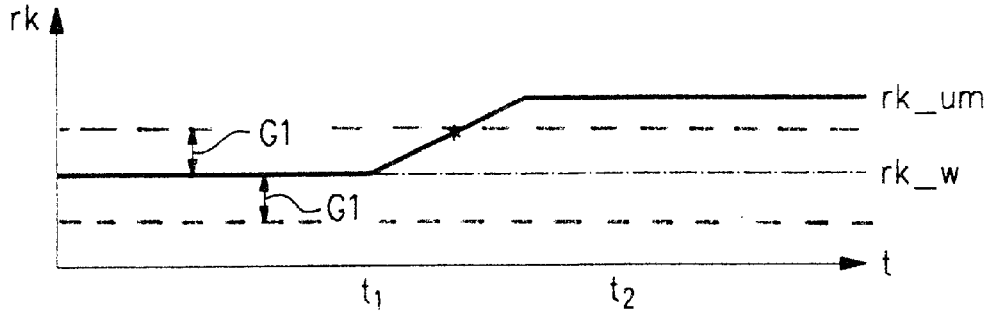
FIG. 7 is a diagram, in which the development of a real fuel quantity and a test fuel quantity of the internal combustion engine of FIG. 1 over the time is represented.

The result of this difference formation is applied in a computing comparator, in which the difference is compared with a threshold value G1. As represented in FIG. 7, the test fuel quantity rk_um begins to diverge in the previous example to the time point t1 from the real fuel quantity rk_w, until it leaves the point in the hatched tolerance graph, designated with a star, the difference, then, larger than G1 is. The divergence of the test fuel quantity rk_um results from the increase of the opening angle dwmsvo of the fuel control valve 32 from compensation of the too-low fuel pressure prist.

The rotational speed nmot is also directly applied in a comparator 70, in which it is compared with a threshold value G3. The comparator 70 affects the comparator 68 such that the comparison in comparator 68 only can be performed when the rotational speed nmot is greater than the threshold value G3. The rotational sped G3 corresponds in the common manner with a rotational speed, which is somewhat higher than the idling speed. An exemplary value for G3 is 1200 rpm.

When it is determined in the comparator 68 that the difference between the real fuel quantity rk_w and the test fuel quantity rk_um is larger than the threshold value G1, a counter is initiated in block 72. This value is compared in a block 74 with a threshold value G2. It should be noted that the counter in block 72 is reset as soon as it is determined in block 68 that the difference between the real fuel quantity rk_w and the test fuel quantity rk_um is again smaller than the threshold value G1. This ensures that only divergences occurring over a longer time frame (for example, 0.5 seconds max) and not only one-time occurring divergences of the test fuel quantity rk_um from the real fuel quantity rk_w are forwarded.

If it is determined in block 74 that the counter 72, which can be a time counter, for example, has exceeded the threshold value G2, an action in block 76 is released. This can include, for example, that the injection time ti_w is placed at zero, that is, no fuel is injected from the injectors 28 into the combustion chamber 30. This means in effect that the internal combustion engine is switched off. In addition, an error bit in an error storage can be read. Also, the production of an alarm signal is possible in block 76. The conversion and protection of the described actions takes place preferably in a separate software routine.

It will be understood that each of the elements described above, or two or more together, may also find a useful application in other types of constructions differing from the types described above.

While the invention has been illustrated and described herein as a method, computer program, and control and/or regulating apparatus for operating an internal combustion engine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. Method for operating an internal combustion engine (10), in which a real fuel quantity (rk_w), which is fed from a high-pressure region (26) of a fuel system (12) into a combustion chamber (30) of the internal combustion engine (10), is dependent on a real rotational moment, wherein a control duration (dwmsvo) of a volume control valve (32) depends on a difference between an ideal pressure (prsoll) and a determined pressure (prist), wherein said volume control valve affects the fuel quantity supplied from a fuel pump (18) into the high-pressure region (26), and wherein a supply output of the fuel pump (18) that supplies into the high-pressure region depends on the rotational speed of a drive shaft of the fuel pump, wherein from a real control duration (dwmsvo) of the volume control valve (32), the rotational speed of the drive shaft of the fuel pump or the determined rotational speed (nmot) of a crankshaft of the internal combustion engine (10) and the determined pressure (prist) in the high-pressure region (26), a test fuel quantity (rk_um) is determined and wherein the test fuel quantity (rk_um) is compared with the real fuel quantity (rk_w) determined from the real rotational moment.

2. Method according to claim 1, wherein a difference (64) between the test fuel quantity (rk_um) and the real fuel quantity (rk_w) is formed and a total difference amount is compared with a threshold value (68).

3. Method according to claim 1, wherein the test fuel quantity (rk_um) is determined by means of two characteristic curves (62).

4. Method according to claim 1, wherein the test fuel quantity is determined by means of a multi-dimensional performance graph.

5. Method according to claim 2, wherein performance (68) of a comparison between the test fuel quantity (rk_um) and the real fuel quantity (rk_w) depends on the rotational speed (nmot) of the crankshaft of the internal combustion engine.

6. Method according to claim 5, wherein with a low rotational speed (nmot) below approximately 1200 rpm of the internal combustion engine (10), no comparison between the test fuel quantity (rk_um) and the real fuel quantity (rk_w) takes place.

7. Method according to claim 1, wherein, when the test fuel quantity (rk_um) and the real fuel quantity (rk_w) diverge from one another beyond an allowable value, an error message and/or an alarm is activated (76).

8. Method according to claim 7, wherein a safety step (76) is performed based on the error message.

9. Method according to claim 8, wherein the safety step (76) is only performed when the error message is produced over a determined amount of time.

10. Method according to claim 9, wherein the safety step includes switching off a supply of fuel.

11. Computer program, wherein said program is adapted to perform the method of claim 1 when said method is performed in a computer.

12. Computer program according to claim 11, wherein said program is stored on a flash memory storage.

13. Control and/or regulating apparatus (38) for operating an internal combustion engine (10), comprising a storage, wherein the computer program of claim 11 is stored on said storage.

* * * * *